United States Patent [19]

Torgow

[11] 4,264,073

[45] Apr. 28, 1981

[54] GAME APPARATUS

[76] Inventor: Abraham M. Torgow, 185 E. 206th St., New York, N.Y. 10458

[21] Appl. No.: 23,730

[22] Filed: Mar. 26, 1979

[51] Int. Cl.[3] ..... A63F 7/36

[52] U.S. Cl. ..... 273/125 A

[58] Field of Search ..... 273/122 A, 123 A, 124 A, 273/125 A, 120 A, 119 A, 118 A, 121 A

[56] References Cited

U.S. PATENT DOCUMENTS

| | | | |
|---|---|---|---|
| 1,614,471 | 1/1927 | Hayashi | 273/125 A |
| 2,004,990 | 6/1935 | Kirk et al. | 273/125 A |
| 2,418,598 | 4/1947 | Nicolaus | 273/125 A |
| 2,541,266 | 2/1951 | Metz | 273/124 A |
| 3,034,790 | 5/1962 | Breitenstein | 273/118 A |
| 3,348,844 | 10/1967 | Lemelson | 273/121 A |

FOREIGN PATENT DOCUMENTS

| | | | |
|---|---|---|---|
| 0504979 | 5/1939 | United Kingdom | 273/123 A |

*Primary Examiner*—Peter Chin

*Attorney, Agent, or Firm*—Neophytos Ganiaris

[57] ABSTRACT

A game apparatus consisting of a housing with a generally triangular game playing surface. A ball is rolled on the playing surface either manually or by a conventional shooting device. The playing surface has openings and the ball, propelled from the front towards the rear end, falls into one of the openings, enters in the interior of the housing and rolls back towards the front end. One center rectangular opening in the rear end wall is designated as a "functional" opening and the interior of the housing has electrical wiring and a switching device for starting and stopping a motor which rotates an ornamental disc whenever the ball falls into the "functional" opening.

1 Claim, 7 Drawing Figures

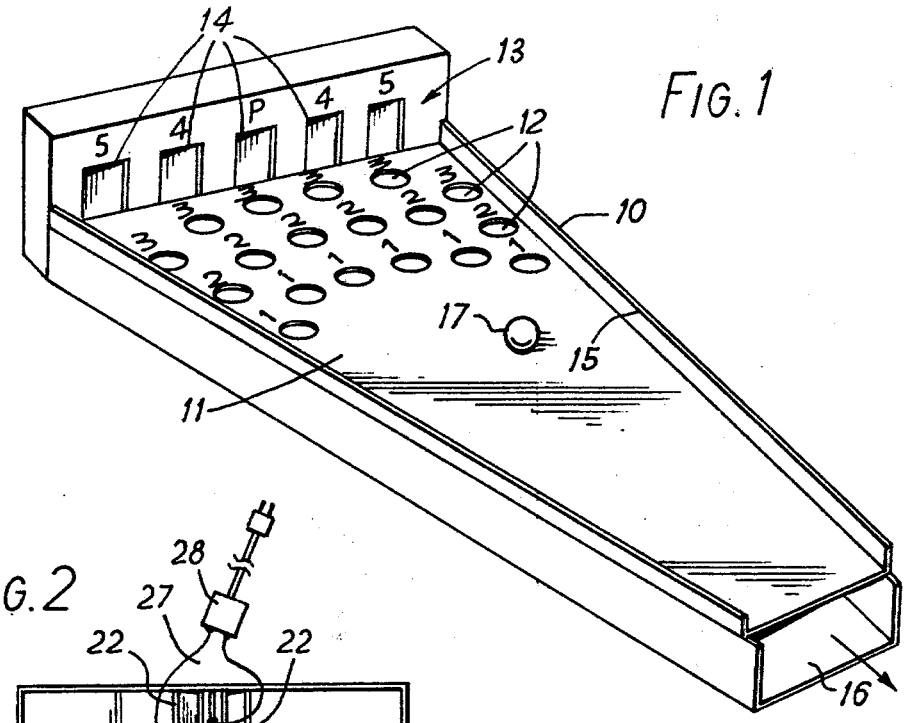
FIG. 1
FIG. 2
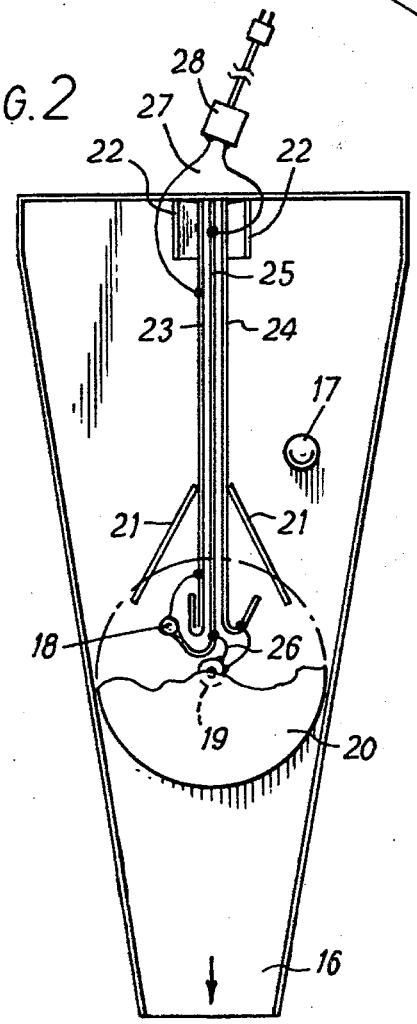
FIG. 3
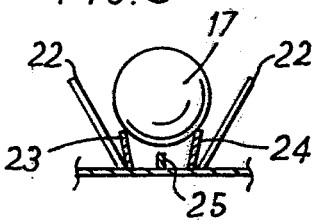
FIG. 4
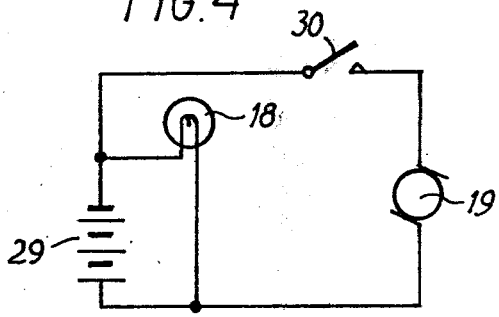

GAME APPARATUS

This invention relates to an apparatus for playing a game which combines intellectual decision making and physical skill.

OBJECTS OF THE INVENTION

It is the primary object of the present invention to provide a new game apparatus which comprises a housing with a playing surface, a ball to be rolled as the playing surface, openings to allow the ball to enter the interior of the housing and, in turn, indicate a points score for each player, and means for the ball to roll out of the housing.

Another object of this invention is to provide a new time switch to be activated by the ball whenever the ball enters one designated opening.

SUMMARY OF THE INVENTION

In its broadest aspect, the game apparatus of the invention comprises:

(i) a housing having a playing surface and including a plurality of openings dimensioned to permit passage of a ball rolled along the playing surface (ii) inclined elongated support means positioned below said playing surface to receive a ball which has passed through a selected one of said openings (iii) an indicator coupled for activation by an electric powered device (iv) a source of electric current, and (v) electrical wiring connecting said current source, said support means, and said electric powered device, said support means being adapted upon receiving said ball to complete a current feed circuit to said powered device and to maintain said current feed circuit for at least a portion of a period of time during which said ball rolls along said inclined support means.

In a first preferred embodiment, said inclined support means apparatus, as claimed in claim 1, wherein said inclined support means includes a pair of spaced adjacent elongated electrical conductors adapted to be bridged electrically by an electrically conductive ball.

In a second preferred embodiment, said inclined support means apparatus, as claimed in claim 1, wherein said inclined support means includes an elongated rail mounted intermediate its ends by a horizontal pivot to said housing, said rail carrying one of a pair of cooperating contacts arranged in said current feed circuit, said rail having a rest position pivoting in which said contacts are open, said rail being adapted upon receiving said ball to be moved by the weight of said ball to an operated position of pivoting in which said contacts are closed and, after said ball has rolled along a portion of the length of said rail, to be returned to said rest position.

In a third preferred embodiment, said inclined support means apparatus, as claimed in claim 1, wherein said inclined support means includes an elongated resiliently bendable rail mounted to said housing and having a portion resiliently movable with respect to said housing, said movable portion carrying one of a pair of cooperating contacts arranged in said current feed circuit, said movable portion of said rail having an unconstrained rest condition in which said contacts are open, said movable portion of said rail being adapted upon receiving said ball to be moved to a constrained position of resilient deformation in which said contacts are closed and, after said ball has rolled along a portion of the length of said rail, to be restored to said rest position.

These and other features, objects and advantages of the invention will be apparent during the course of the following description taken in conjunction with the accompanying drawings.

BRIEF DESCRIPTION OF THE DRAWINGS

In the drawings:

FIG. 1 is a perspective view of the apparatus embodying the invention;

FIG. 2 is a plan view of the interior of the apparatus of FIG. 1, showing the electrical wiring, switching means, motor and rotating disc, incandescent light bulb and guiding channels;

FIG. 3 is an end view of a time switch which may be used with this invention;

FIG. 4 is an electrical wiring diagram for the incandescent light bulb and motor employed in accordance with the invention;

DESCRIPTION OF THE PREFERRED EMBODIMENTS

Figure 5:
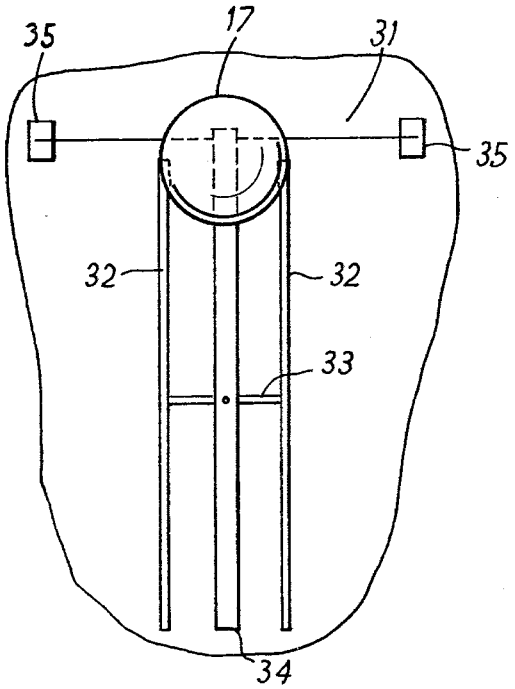
FIG. 5 is a plan view of a rocking rod type of time switch which may be used with this invention.

As shown in FIG. 1 a housing 10 has a generally triangular transparent or transluscent game playing surface 11 with three rows of six circular openings 12, a rear end wall 13 projecting above the playing surface 11 and having five rectangular openings 14, side retaining walls 15 projecting above the playing surface 11, and a large front end opening 16. A ball 17 is rolled on the playing surface 11 from the front or narrow end towards the openings 12 and 14 at the rear or wide end, by use of a conventional shooting device (not shown) or by hand. The ball can fall into any one of the openings 12 or 14, enter the interior of the housing and then roll out of the housing through the front end opening 16. The housing 10 can be either constructed with a small inclination so that the ball 17 will roll out of the interior of the housing by itself, or the housing may be placed on a sloping platform whenever a game is to be played.

The points scored by the player whenever the ball 17 enters an opening 12 or 14 are shown by arabic numerals in front of each circular opening 12 or above each rectangular opening 14, as indicated in FIG. 1. The letter P above the center rectangular opening designates that it is a "functional" opening; whenever the ball enters into this opening, the player, depending on the rules of the game, might have an extra chance to roll the ball and/or multiply or divide his accumulated points score by a factor.

The size of the openings is related to the size of the ball; for a ball having a half-inch diameter, the circular openings have a diameter of 1.25 inches and the rectangular openings are 1.25×1.5 inches. Also, the distance between two openings should be at least equal to the ball diameter.

A plan view of the interior of the housing 10, as shown in FIG. 2, indicates that the housing is equipped with an ornamental incandescent light bulb 18, a d.c. motor 19 for rotating an ornamental disc 20, diverters 21 to ensure that the ball 17 will roll freely towards opening 16, a channel 22 for quiding the ball 17 to roll on a pair of metal strips 23 and 24, to act as contacts whenever the ball enters the "functional" opening P, which is shown in FIG. 1.

A transformer-converter 28, having a plug which can be plugged into an a.c. electrical outlet, feeds d.c. current to one of a pair of metal strips 23 and 25 and, in conjunction with further electrical wires, to the light bulb 18 and d.c. motor 19. The metal strips 23, 24 and 25, and the further wires are electrically insulated from each other.

The ball 17 upon entering the "functional" opening P falls into channel 22 and is guided on to the metal strips 23 and 24 as shown in FIG. 3. Since the entire game apparatus has a small inclination towards the front-end, the ball will roll in that direction on metal strips 23 and 24; these metal strips form a channel to ensure that the ball will not fall off to the side. A ball made of an electrically conducting material will close the electrical circuit for the d.c. motor 19; thus, the motor 19 will start running, as soon as the ball 17 completes a circuit between the two metal strips 23 and 24. The motor will continue to run as long as the ball maintains such contact. As soon as the ball rolls off the strips 23, 24, the electrical circuit for the motor will be broken and the motor will stop. The ball 17, and the metal strips 23 and 24 together act as a time switch for the motor 19.

The electrically conducting metal strip 25 does not come in contact with the ball 17, as shown in FIG. 3. This metal strip could be replaced by an electrical wire.

The electrical circuit diagram for the incandescent light bulb 18 and the d.c. motor 19 is shown in FIG. 4. The switch 30 is the time switch which consists of the metal strips 23 and 24 and the electrically conducting ball 17. The source of electricity could alternatively be a battery 29 as shown in FIG. 4 or several batteries connected together, or any other suitable source of electrical energy with the appropriate electrical wiring to ensure the safety of the players.

The time switch 30 is closed only for a brief period of time; the time should be sufficiently long to turn on the motor 19 and, in turn, spin the ornamental disc 20 so that the player can have a clear visual indication that the ball has entered into the "functional" opening P. A time period of 1–2 secs. is sufficient for running the motor and obtaining the desired visual effect with the spinning of the ornamental disc. The time can be adjusted to the desired period by increasing or decreasing the inclination of the apparatus; also, the length of the metal strips 23 and 24, the weight of the ball, and its surface roughness will affect the time period of maintaining a closed circuit for the motor.

In another embodiment of this invention, the time switch 30 is constructed as a rocking rod, as shown in FIG. 5. A rod 34 is supported in the middle on a pivot 33 and is slightly tilted towards the front end. Two electrically conductive metal plates 35 are fixed on the base at the interior of the housing at the rear end, and are wired into the electrical circuit of the motor 19 and insulated from each other so that no electric current flows across them and, thus, the circuit is normally open. An electrically conductive wire 31 is fastened horizontally on the rocking rod 34 at the rear end. The ball 17 enters into the "functional" opening P and falls into a channel 32 in the interior of the housing. The weight of the ball tilts the rod 34 at the rear end and moves the wire 31 down into contact with the plates 35 and thus, closes the circuit and turns on the motor. The ball subsequently rolls towards the front end, due to the inclination of the entire housing, and the circuit for the motor is opened as soon as the ball passes the middle point where the rod 34 is supported; the weight of the ball tilts the rod towards the front end and the wire 31 is lifted upwards and, thus, it is no longer in contact with the electrically conductive metal plates, so that the circuit is broken. The ball 17 in this embodiment of the invention can be made of plastics, metal, wood, or any other safe material for a game apparatus; however, the ball should have sufficient weight so that the rocking rod 34 is tilted and the wire 31 is pressed into contact with the plates 35 in order to close the circuit for the motor. Also, the electrically conductive metal plates 35 are preferably provided with a V-shaped groove (not shown) so that the wire 31 may seat into it and, provide good contact between the plates and the wire.

Figure 6:
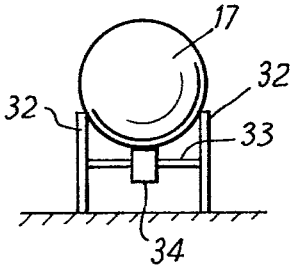
FIG. 6 is an end elevational view of the rocking rod time switch shown in FIG. 5.

As shown in FIG. 6 the ball 17 is rolling on the rocking rod 34, and is retained on the rod by the guiding channel 32. The channel 32 prevents the ball from falling off to either side.

Figure 7:
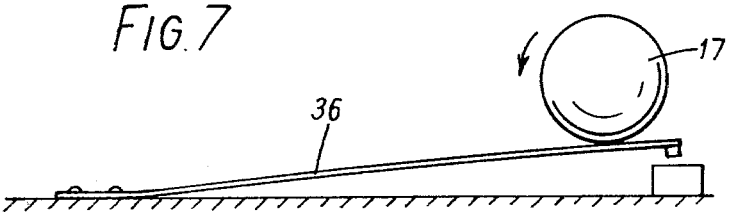
FIG. 7 is a side view of an alternative time switch having a resilient plastic strip.

In another embodiment of this invention, the rocking rod 34 is replaced by a resilient plastic strip 36 shown in FIG. 7. The strip 36 is fixed to the base of the housing 10 at the front end and is located in the channel 32. Also, an electrically conductive wire is fastened to the rear end of the strip 36 in a manner similar to the fastening of the wire 31 to the rocking rod shown in FIG. 5. The ball 17 enters the "functional" opening P, falls into channel 32 and presses down the rear end of the resilient plastics material. The electrical wire 31 which is fastened to the rear end of the strip 35 is pressed down into contact with the metal plates 35 and closes the electrical circuit for the motor 19. As the ball rolls towards the front end due to the inclination of the entire apparatus, the resilient plastics strip 36 springs back to its normal position shown in FIG. 7, and the electrical circuit for the motor is opened.

The resilient strip 36 can be made from materials other than plastics; any resilient material will be satisfactory for this embodiment of the invention; a metallic strip with sufficient resilience or one made of wood would be satisfactory. Also, the ball could be made of any material which is safe for a game apparatus. However, the weight of the ball is related to the resilience of the strip 36; the ball should have sufficient weight to push down the rear end of the strip and, in turn, press the wire 31 into contact with the electrical wiring, in order to close the electrical circuit for the motor.

The channel 32 shown in FIG. 5 and FIG. 6 is also used with the resilient plastic strip 36 in order to prevent the ball 17 from falling off to the side.

The game apparatus of my invention is used in play as follows:

The entire apparatus is placed on any sloping platform, or is raised at the rear end, so that there is sufficient inclination for the ball to roll freely in the interior of the housing towards the front end opening. The electrical transformer-converter is plugged into an a.c. electrical outlet and current flows to the electrical circuit of the light bulb and d.c. motor. The player has three chances to roll the ball on the playing surface. A cumulative points score is achieved depending upon which opening the ball enters each time it is rolled. If the ball enters the "functional" opening P, the player has an extra chance to roll the ball and, thus, achieve a higher overall score. Under another set of rules, the cumulative points score is multiplied or divided by a factor. Thus, under one set of rules, the player might concentrate his efforts for rolling the ball into the "functional" opening, whereas under another set of rules he would try to avoid rolling the ball into this specific opening.

The description of the playing of the game has been brief and is merely exemplary. Many rule modifications are possible. Also the game apparatus can be varied. For example, multiple ornamental incandescent light bulbs can be used at different locations on the apparatus; the motor and the spinning disc could be located vertically at the rear end or on the side of the housing; the spinning disc could be marked with arabic numerals and indicate a points score when it stops after each spin; the playing surface can be made of a material other than a transparent or transluscent plastics material (e.g. wood). Also, the entire housing can be constructed from various materials—plastics, wood and metal.

A large-scale version of the game can be played using a large ball and large openings in a similar fashion as for bowling alleys; the ball will be rolled on a large game-playing surface by hand. Other large-scale versions will be either to kick the ball by foot as in soccer or to hit the ball with a rod in a manner similar to a golf game.

While this invention has been shown and described in the best forms known, it will nevertheless be understood that this is purely exemplary and that modifications may be made without departing from the scope of the invention as defined in the appended claims.

I claim:

1. Apparatus, for playing a game, comprising:

(i) an elongated housing with upper and lower walls forming top and bottom surfaces and having a first end and a second end, said upper wall forming a top playing surface extending in the direction from said first end to said second end and having a plurality of horizontal openings therein dimensioned to permit vertical downward passage of a ball rolled along said playing surface, and an upstanding end wall bounding said playing surface at said first end and having at least one vertical opening positioned to receive horizontally through it a ball rolling from said second end on said playing surface, (ii) an elongated ball supporting and guiding means disposed below said playing surface and upstanding end wall and having one end positioned below said at least one vertical opening to receive a ball passing through said opening by gravity, said ball supporting and guiding means extending from said one end towards the second end of the housing and being inclined for return of said ball rolling by gravity towards said second end of the housing, said ball supporting and guiding means being included in an electrical switch comprising a pair of spaced elongated continuous adjacent electrical conductors bridgable by an electrically conductive ball of sufficient weight and surface roughness to roll along said conductors for a time of 1 to 2 seconds, (iii) an indicator coupled for actuation by an electric powered device, (iv) a source of electric current, and (v) electrical wiring connecting said current source, said switch, and said electric powered device, said ball supporting and guiding means serving upon receiving a ball dropping on said one end to complete a current feed circuit to said powered device and to maintain said current feed circuit for at least a portion of a period of time taken by the ball to roll along said ball supporting and guiding means towards said second end of the housing.

* * * * *